US010309726B2

(12) United States Patent
Humfeld et al.

(10) Patent No.: US 10,309,726 B2
(45) Date of Patent: Jun. 4, 2019

(54) HINGED BAFFLE FOR AUTOCLAVE THAT DEPLOYS AT A TARGET TEMPERATURE DURING A RUN CYCLE

(71) Applicant: The Boeing Company, Chicago, IL (US)

(72) Inventors: Keith Daniel Humfeld, Federal Way, WA (US); Steven Shewchuk, St. Louis, MO (US)

(73) Assignee: The Boeing Company, Chicago, IL (US)

( * ) Notice: Subject to any disclaimer, the term of this patent is extended or adjusted under 35 U.S.C. 154(b) by 727 days.

(21) Appl. No.: 14/869,892

(22) Filed: Sep. 29, 2015

(65) Prior Publication Data

US 2017/0089641 A1 Mar. 30, 2017

(51) Int. Cl.

| | |
|---|---|
| ***F27D 7/04*** | (2006.01) |
| ***F27D 19/00*** | (2006.01) |
| ***F27D 7/06*** | (2006.01) |
| ***F27B 5/04*** | (2006.01) |

(52) U.S. Cl.

CPC ..... *F27D 19/00* (2013.01); *F27B 5/04* (2013.01); *F27D 7/04* (2013.01); *F27D 7/06* (2013.01); *F27D 2019/0028* (2013.01)

(58) Field of Classification Search

CPC ..... F27D 7/04

See application file for complete search history.

(56) References Cited

U.S. PATENT DOCUMENTS 4,974,663 A * 12/1990 Nakaji ..... B01J 3/002 165/58

5,203,392 A * 4/1993 Shea ..... A62C 2/242 160/133

FOREIGN PATENT DOCUMENTS

| | | |
|---|---|---|
| EP | 2471593 A2 | 7/2012 |
| WO | 2014179041 A1 | 11/2014 |

* cited by examiner

*Primary Examiner* — Donald R Spamer

(74) *Attorney, Agent, or Firm* — Duft & Bornsen, PC

(57) ABSTRACT

Apparatus and methods for operating an autoclave. One embodiment includes a baffle located in an autoclave during a run cycle of the autoclave. A release mechanism secures the baffle in a retracted position during the run cycle, and automatically releases the baffle to a deployed position during the run cycle, when a temperature inside of the autoclave reaches a target temperature, to alter airflow within the autoclave.

31 Claims, 8 Drawing Sheets

HINGED BAFFLE FOR AUTOCLAVE THAT DEPLOYS AT A TARGET TEMPERATURE DURING A RUN CYCLE

FIELD

This disclosure relates to the field of manufacturing, and more particularly, to autoclaves and associated manufacturing process that use autoclaves.

BACKGROUND

An autoclave is a device used in manufacturing of components, such as components made from composite materials. An autoclave includes a vessel where the pressure and temperature is controllable. Workpieces are placed inside the vessel, and the vessel is sealed. The vessel is then pressurized by pumping air or other gases through the vessel. The air enters the vessel through air inlets, and exits the vessel through air outlets. The temperature inside of the vessel may be controlled by the heating or cooling the air that is pumped through the vessel. The high-temperature and high-pressure capabilities of an autoclave make it useful for manufacturing processes, such as curing composite materials.

Although the pressure inside of the vessel is substantially uniform, the temperature of the workpiece being cured in the autoclave may not be uniform across its extent. This can be problematic when curing composite members, as some portions of a composite member may reach and maintain a proper cure temperature, while other portions may not. If portions of a composite member heat at different rates, the quality of the composite member may be compromised.

SUMMARY

Embodiments herein describe a baffle that is deployable during a run cycle of an autoclave. One or more of the baffles are installed in the interior of the autoclave in a non-deployed or retracted position. During a run cycle, the baffle automatically deploys when a temperature within the autoclave reaches a target temperature. In a deployed position, the baffle alters the airflow through the autoclave, and consequently changes the heat transfer coefficient at the surface of a workpiece in the autoclave. Therefore, the local heat transfer coefficients within the autoclave can be changed at different locations during a run cycle by deploying the baffle(s).

One embodiment comprises an apparatus that includes a baffle located in an autoclave during a run cycle of the autoclave. The apparatus also includes a release mechanism that secures the baffle in a retracted position during the run cycle, and automatically releases the baffle to a deployed position during the run cycle when a temperature inside of the autoclave reaches a target temperature. In the deployed position, the baffle alters airflow within the autoclave.

In another embodiment, the baffle attaches to a location inside of the autoclave with a hinge mechanism, where the baffle is configured to pivot via the hinge mechanism from the retracted position to the deployed position.

In another embodiment, the release mechanism includes a material that melts at the target temperature to release the baffle to the deployed position.

In another embodiment, the release mechanism includes a material that softens at the target temperature, and flexes to release the baffle to the deployed position.

In another embodiment, the release mechanism includes a Shape-Memory Alloy (SMA) material that has a first shape to secure the baffle in the retracted position, and transforms to a second shape at the target temperature to release the baffle to the deployed position.

In another embodiment, the apparatus includes a spring mechanism that loads when the baffle is secured in the retracted position, and applies a return force to pivot the baffle to the deployed position when released by the release mechanism.

In another embodiment, the apparatus includes a stop device that stops rotation of the baffle at the deployed position.

In another embodiment, the apparatus includes an indicator mechanism that indicates when the baffle is released to the deployed position.

In another embodiment, the indicator mechanism includes a thermocouple wire installed in a path between the retracted position and the deployed position of the baffle. The baffle breaks a connection of the thermocouple wire when pivoting from the retracted position to the deployed position.

Another embodiment comprises an autoclave and one or more baffle elements installed within the autoclave. The baffle element includes a baffle, a hinge mechanism that attaches the baffle to a surface inside of the autoclave, and a release mechanism that secures the baffle in a retracted position during a run cycle of the autoclave. The release mechanism automatically releases the baffle to a deployed position during the run cycle when a temperature inside of the autoclave reaches a target temperature.

Another embodiment comprises a method of operating an autoclave. The method includes performing a thermal-analysis of an interior of the autoclave, selecting a location for a baffle element within the autoclave based on the thermal-analysis, and installing the baffle element at the location. The method includes selecting a target temperature for deploying a baffle of the baffle element during a run cycle of the autoclave, and securing the baffle in the retracted position with a release mechanism. The method further includes initiating the run cycle, and releasing the baffle to the deployed position with the release mechanism during the run cycle when a temperature inside of the autoclave reaches the target temperature.

In another embodiment, the method includes selecting the release mechanism that changes state at the target temperature.

In another embodiment, the method includes selecting a material for the release mechanism that melts at the target temperature to release the baffle to the deployed position.

In another embodiment, the method includes selecting a material for the release mechanism that softens at the target temperature, and flexes to release the baffle to the deployed position.

In another embodiment, the method includes selecting a Shape-Memory Alloy (SMA) material for the release mechanism that transforms shapes at the target temperature to release the baffle to the deployed position.

In another embodiment, the method includes installing an indicator mechanism that indicates when the baffle is released to the deployed position.

In another embodiment, the method includes installing a thermocouple wire in a path between the retracted position and the deployed position of the baffle, where the baffle breaks a connection of the thermocouple wire when pivoting from the retracted position to the deployed position.

Another embodiment comprises a method of controlling heat within an autoclave. The method includes initiating a run cycle of the autoclave, and deploying a device within the autoclave during the run cycle to alter the airflow within the autoclave and change the heat transfer to one or more regions of the workpiece.

The features, functions, and advantages that have been discussed can be achieved independently in various embodiments or may be combined in yet other embodiments, further details of which can be seen with reference to the following description and drawings.

DESCRIPTION OF THE DRAWINGS

Some embodiments of the present invention are now described, by way of example only, with reference to the accompanying drawings. The same reference number represents the same element or the same type of element on all drawings.

DETAILED DESCRIPTION

The figures and the following description illustrate specific exemplary embodiments. It will be appreciated that those skilled in the art will be able to devise various arrangements that, although not explicitly described or shown herein, embody the principles described herein and are included within the contemplated scope of the claims that follow this description. Furthermore, any examples described herein are intended to aid in understanding the principles of the disclosure, and are to be construed as being without limitation. As a result, this disclosure is not limited to the specific embodiments or examples described below, but by the claims and their equivalents.

Figure 1:
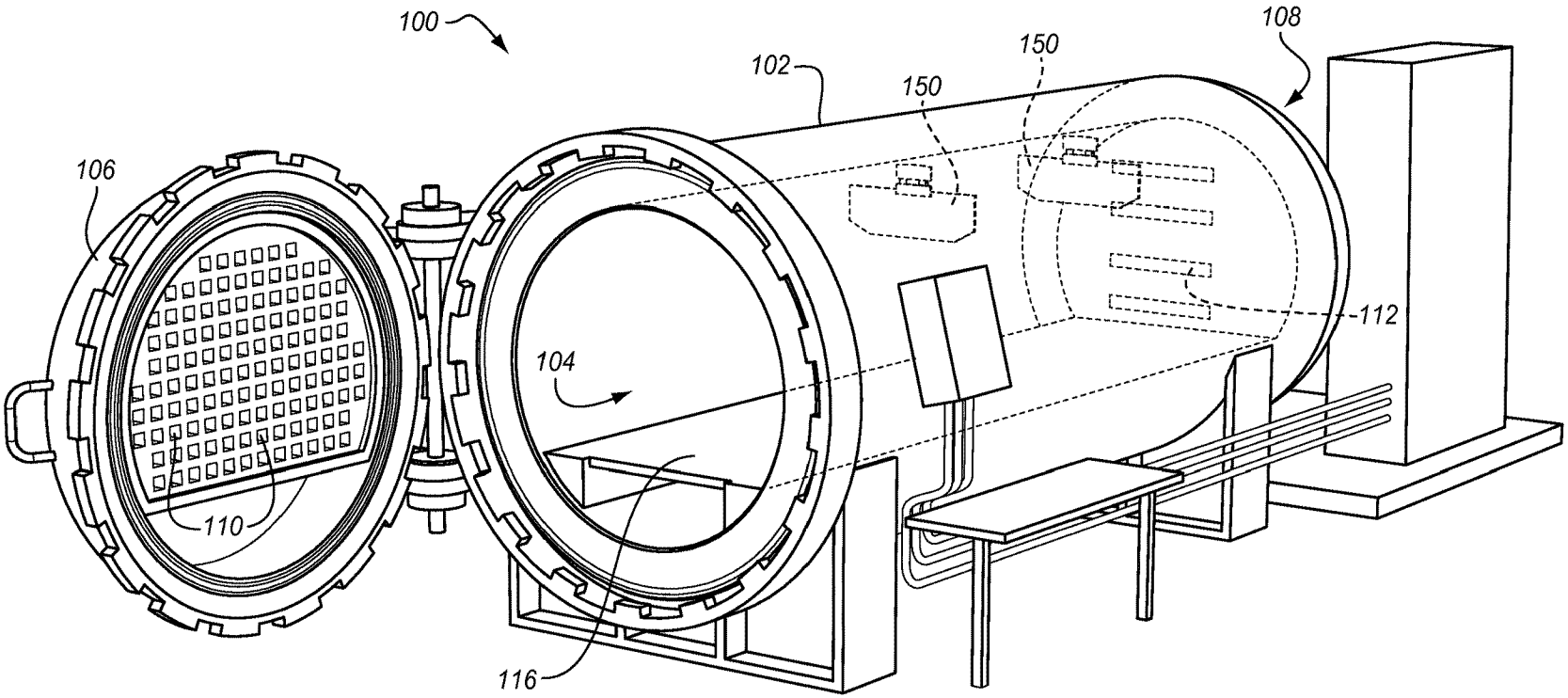
FIG. 1 illustrates an autoclave in an exemplary embodiment.

FIG. 1 illustrates an autoclave 100 in an exemplary embodiment. Autoclave 100 includes a cylindrical vessel 102 having an interior 104 in which workpieces are placed during a run cycle. Vessel 102 has a door 106 located at one end, and a wall 108 or enclosure located on the opposing end. Door 106 includes a plurality of air inlets 110, and wall 108 includes one or more air outlets 112. Air is introduced into vessel 102 through air inlets 110, circulates through the interior 104 of vessel 102, and exits out of air outlets 112. Autoclave 100 may include one or more fans that blow air into air inlets 110, and may include a heater for heating the air that is circulated through vessel 102. Vessel 102 also includes a platform 116 or catwalk to allow operators to walk into autoclave 100 to load or remove workpieces, perform maintenance, etc. Substructures may be placed on platform 116, and the workpieces may be loaded onto the substructures for a run cycle. The structure of autoclave 100 is just an example, and the embodiments described below may apply to different types of autoclaves.

For a typical run cycle of autoclave 100, one or more workpieces are loaded into vessel 102, and door 106 is sealed. Pressure is applied to vessel 102 by introducing air into air inlets 110, while the temperature in vessel 102 is ramped up to a hold temperature. The temperature within vessel 102 may be held at this temperature for a length of time to complete a process, such as a cure process. Although the pressure inside vessel 102 is uniform, the air speed may vary inside vessel 102. As hot air flows through vessel 102 from air inlets 110 to air outlets 112, the airflow may not have a consistent pattern throughout the volume of vessel 102. The uneven airflow leads to temperature variations across workpieces within vessel 102. The temperature variations may depend on the design of vessel 102, the shape of the workpiece(s), placement of the workpiece(s) within vessel 102, the shape of substructures within vessel 102, etc.

The following embodiments are able to compensate for the temperature variations within autoclave 100 and other types of autoclaves using one or more deployable baffle elements 150 that automatically deploy during a run cycle. As shown in FIG. 1, one or more baffle elements 150 are installed in the interior 104 of autoclave 100. Baffle element 150 comprises any device or component within autoclave 100 that is deployable during a run cycle to change airflow within autoclave 100. As will be further described below, baffle element 150 is initially set in a retracted position where it causes little or no turbulence in the airflow within autoclave 100. During a run cycle of autoclave 100, baffle element 150 automatically deploys at a certain temperature to a position where it causes turbulence in the airflow. The turbulence caused by baffle element 150 changes the airflow pattern within autoclave 100. Increasing the speed of the air flowing across a workpiece improves heat transfer to that workpiece, while decreasing the speed of air flowing across a workpiece decreases heat transfer to that workpiece. Therefore, locations on workpieces within autoclave 100 that are heating quickly or slowly can be changed during a run cycle to improve curing processes or the like.

Figure 2:
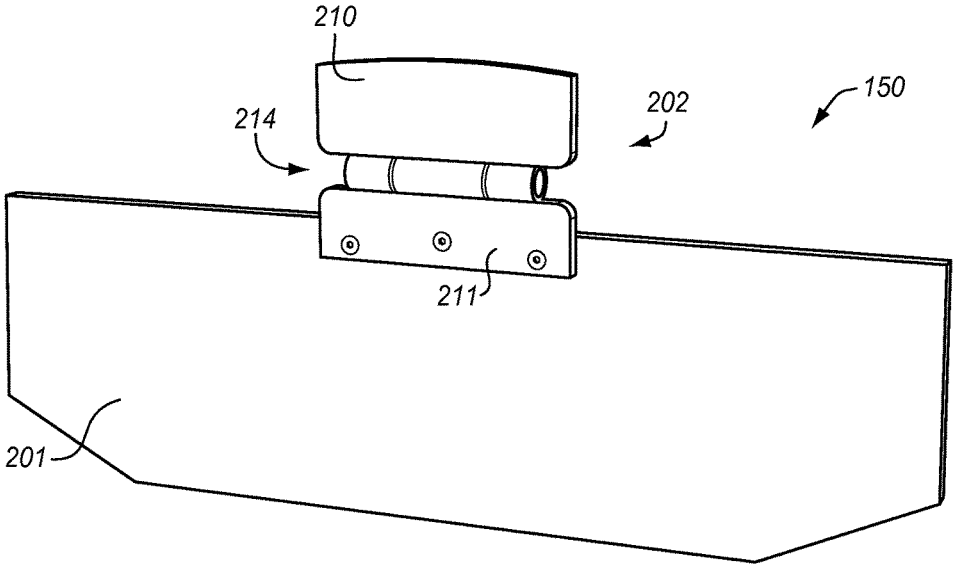
FIG. 2 illustrates a baffle element in an exemplary embodiment.

FIG. 2 illustrates baffle element 150 in an exemplary embodiment. Baffle element 150 is configured to be installed in interior 104 of autoclave 100, and change the airflow within autoclave 100 during a run cycle. Baffle element 150 includes a baffle 201 attached to a hinge mechanism 202. Baffle 201 is a device that restrains the flow of air. The shape and size of baffle 201 as shown in FIG. 2 is just one example, and may vary as desired. Baffle 201 attaches to a surface within autoclave 100 via hinge mechanism 202. Hinge mechanism 202 comprises any structure that pivots at a joint. In this embodiment, hinge mechanism 202 includes a first component 210 for attaching to a surface within autoclave 100, a second component 211 for attaching to baffle 201, and a pivoting joint 214 that connects components 210-211. The structure of hinge mechanism 202 as shown in FIG. 2 is just one example, and may vary as desired.

Figure 3:
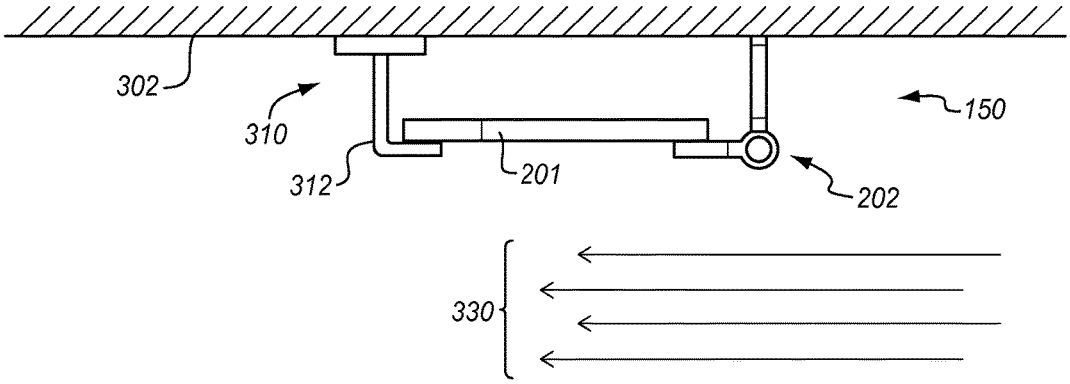
FIG. 3 illustrates a baffle in a retracted position in an exemplary embodiment.

Baffle 201 is configured to transition from a retracted position to a deployed position at a certain temperature. Therefore, baffle element 150 further includes a release mechanism that is configured to hold baffle 201 in the retracted position, and to release baffle 201 to the deployed position during a run cycle at a certain temperature or temperature range, which is referred to as the "target" temperature. FIG. 3 illustrates baffle 201 in a retracted position in an exemplary embodiment. FIG. 3 is a side view of baffle element 150 installed on a surface 302 within autoclave 100. Surface 302 represents any surface within vessel 102 of autoclave 100. Surface 302 may represent the ceiling of autoclave 100, a side wall of autoclave 100, a platform or floor of autoclave 100, a substructure within autoclave 100, etc. Hinge 202 attaches baffle 201 to surface 302, and baffle 201 is pivoted or rotated into the retracted position toward surface 302. The retracted position is where the major surface of baffle 201 is in-plane or substantially in-plane with the airflow 330 within autoclave 100 to cause minimal deflection of the airflow 330. Baffle 201 is secured in the retracted position by a release mechanism 310. Release mechanism 310 is configured to hold baffle 201 in the retracted position below the target temperature, and release baffle 201 at or above the target temperature. For example, release mechanism 310 may include a latch device 312 that attaches to surface 302 (or another surface that is fixed in relation to baffle 201), and contacts baffle 201 (or hinge mechanism 202) to secure baffle 201 in the retracted position.

In order to release baffle 201 at the target temperature, latch device 312 may include a material that melts or softens at the target temperature, such as a metal alloy that includes lead or tin, a thermoplastic, etc. When an operator of autoclave 100 determines the target temperature for baffle 201 to deploy, the operator may also select the type of material for latch device 312 that melts or softens at that target temperature. Latch device 312 will therefore secure baffle 201 in the retracted position as the temperature rises within autoclave 100 during a run cycle. When the temperature reaches the target temperature, latch device 312 will melt to release baffle 201, or will soften and flex to release baffle 201.

Latch device 312 may alternatively include a Shape-Memory Alloy (SMA) that transforms shapes at the target temperature, or a bimetal that flexes at the target temperature. SMAs are strong-lightweight alloys that can be programmed to remember different shapes at different temperatures. Examples of SMA materials include Nickel-Titanium (Ni—Ti), Nickel-Titanium-Hafnium (Ni—Ti—Hf), Copper-Aluminum-Nickel (Cu—Al—Ni), etc. SMAs display two distinct crystal structures or phases. Martensite form exists at lower temperatures, and austenite form exists at higher temperatures. When an SMA is in martensite form at lower temperatures, it can be easily formed to a desired shape. When the SMA is in austenite form at higher temperatures, it can be "trained" to transition into another shape. For example, the SMA may be bent, squeezed, twisted, or otherwise formed to have a different shape when in the austenite form. When made from SMA material, latch device 312 will therefore secure baffle 201 in the retracted position when the SMA material is in its low-temperature (martensite) shape. When the temperature reaches the target temperature, the SMA material in latch device 312 will transition from its low-temperature (martensite) shape to its high-temperature (austenite) shape and release baffle 201.

Release mechanism 310 may have other desired structures not shown so that latch device 312 releases baffle 201 at the target temperature. For example, latch device 312 may be coupled to an actuator. A controller may measure a temperature within autoclave 100 through a temperature sensor, and reposition latch device 312 through the actuator when the temperature reaches the target temperature in order to release baffle 201.

Figure 4:
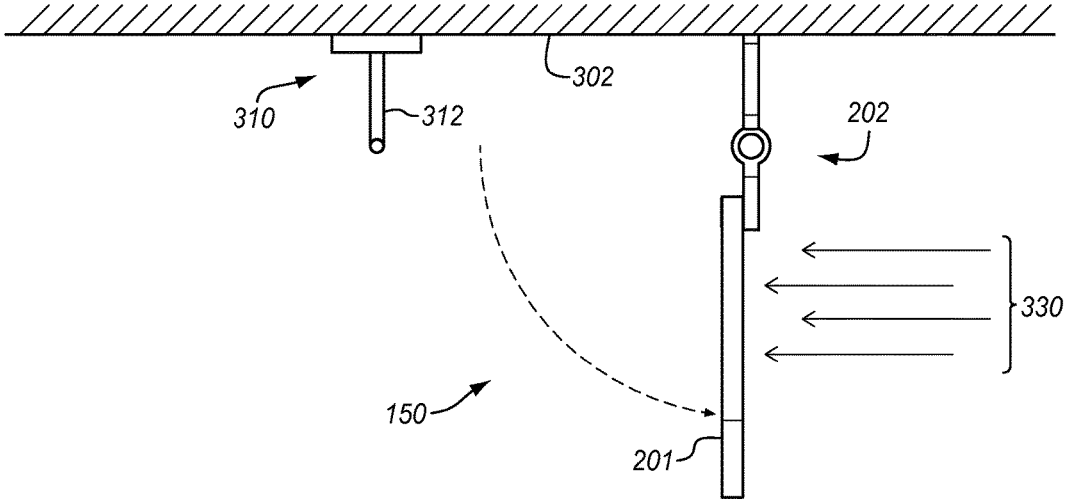
FIG. 4 illustrates a baffle in the deployed position in an exemplary embodiment.

FIG. 4 illustrates baffle 201 in the deployed position in an exemplary embodiment. FIG. 4 is again a side view of baffle element 150 installed in autoclave 100. To transition to the deployed position, baffle 201 is pivoted or rotated away from surface 302 via hinge mechanism 202. The deployed position is where the major surface of baffle 201 is out-of-plane with the airflow 330 within autoclave 100 to cause deflection of the airflow 330. As illustrated in FIG. 4, baffle 201 pivots on hinge mechanism 202 from the retracted position to the deployed position. When in the deployed position, baffle 201 will perturb or alter the airflow 330 within autoclave 100 which in turn alters the temperature distribution within autoclave 100.

Figure 5:
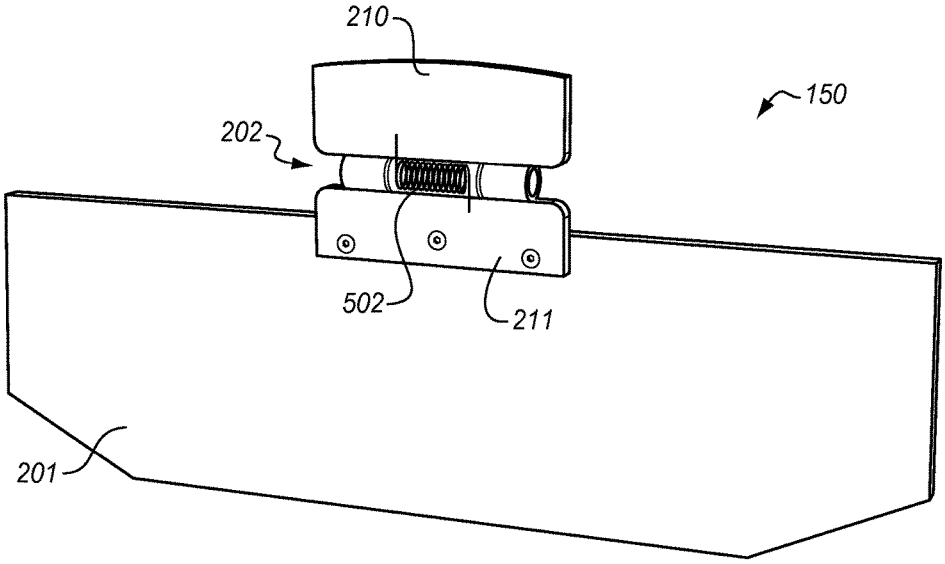
FIG. 5 illustrates a spring mechanism for assisting the deployment of the baffle in an exemplary embodiment.

Baffle 201 may pivot from the retracted position to the deployed position due to gravity. The weight of baffle 201 may be selected so that it overcomes the force of airflow 330, and baffle 201 is able to pivot to and remain in the deployed position. Deployment of baffle 201 may also be assisted with a spring mechanism or the like. FIG. 5 illustrates a spring mechanism 502 for assisting the deployment of baffle 201 in an exemplary embodiment. In this embodiment, spring mechanism 502 is installed between components 210 and 211 of hinge mechanism 202. Spring mechanism 502 loads when baffle 201 is pivoted into the retracted position, and applies a return force to pivot baffle 201 to the deployed position. The return force applied by spring mechanism 502 assists in overcoming the force of airflow 330 so that baffle 201 can fully reach the deployed position and stay in the deployed position. The structure of spring mechanism 502 as shown in FIG. 5 is just one example, and may vary as desired.

Figure 6:
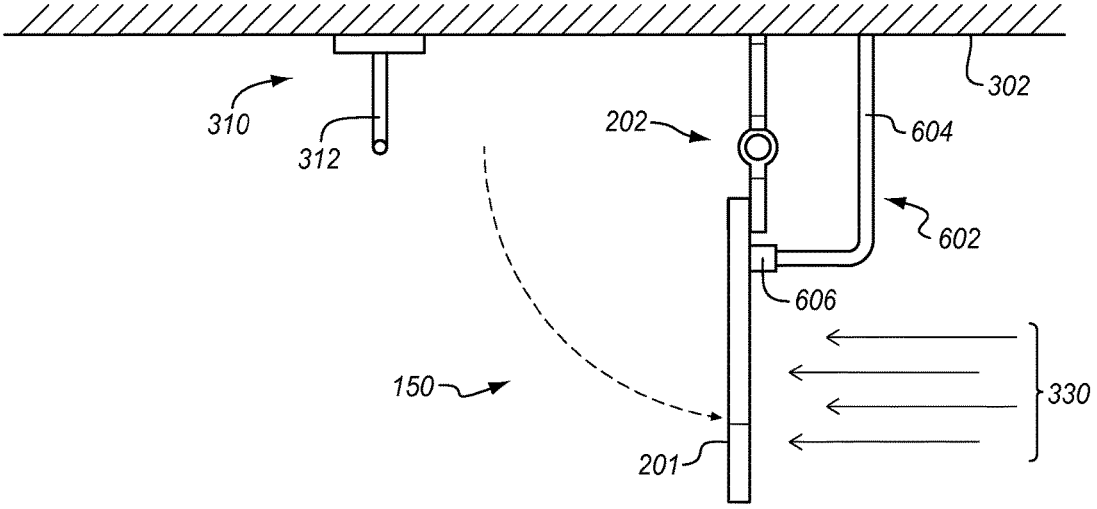
FIG. 6 illustrates a stop mechanism in an exemplary embodiment.

In order to stop baffle 201 at the deployed position, baffle element 150 may include a stop mechanism that is used in conjunction with hinge mechanism 202. The stop mechanism may comprise any structure or device that stops the rotation of baffle 201 via hinge mechanism 202 at the deployed position. FIG. 6 illustrates a stop mechanism 602 in an exemplary embodiment. Stop mechanism 602 includes one end 604 that attaches to surface 302 (or another surface that is fixed in relation to baffle 201), and another end 606 that is in the path of rotation of baffle 201. When baffle 201 pivots on hinge mechanism 202 and strikes end 606, baffle 201 stops in the desired position. The structure of stop mechanism 602 as shown in FIG. 6 is just an example, and may vary as desired. For example, a spring-loaded pin may be used to act as a stop mechanism for stopping baffle 201 at the deployed position. In another example, a cable may be attached between surface 302 and baffle 201, which stops baffle 201 after pivoting to the deployed position.

Figure 7:
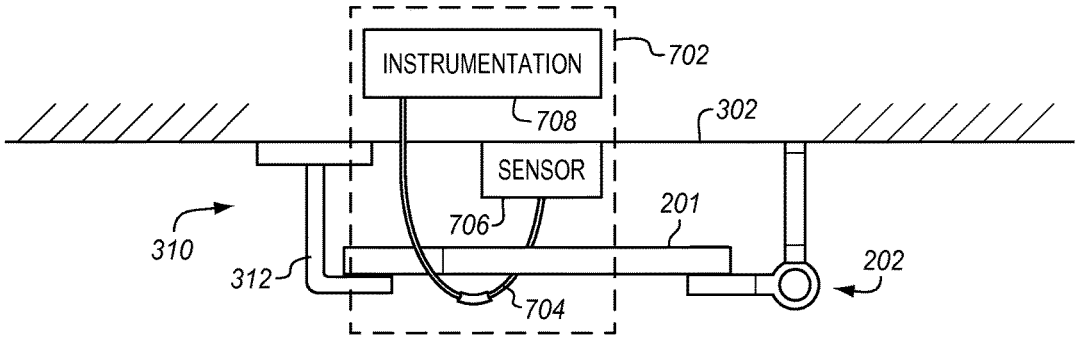
FIGS. 7-8 illustrate an indicator mechanism in an exemplary embodiment.
Figure 8:
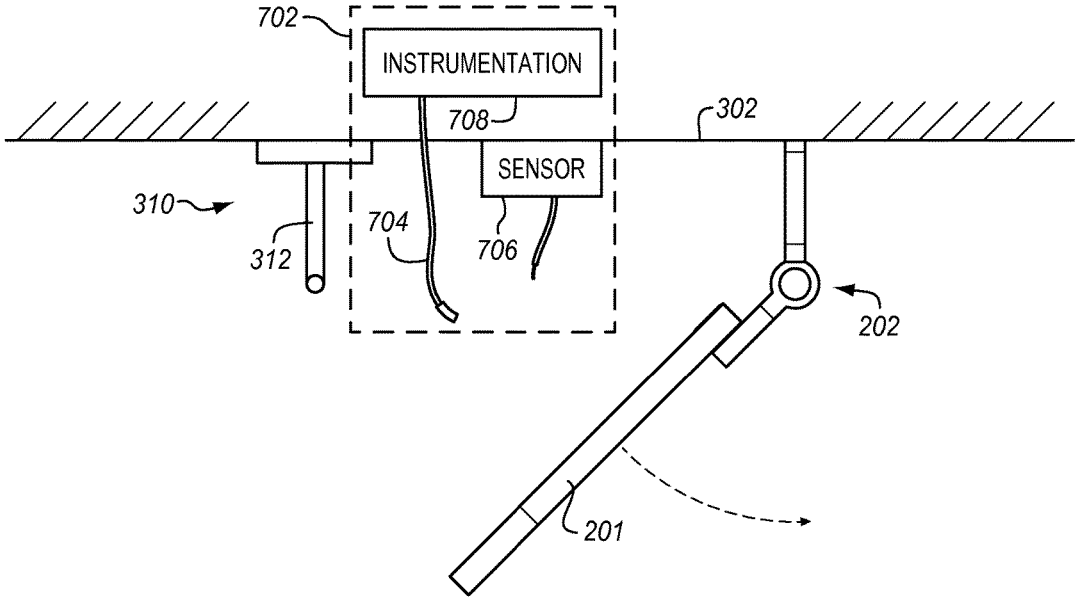

An operator may not be able to see inside autoclave 100 during a run cycle to determine if or when baffle 201 deploys. Therefore, it may be advantageous to install a device in autoclave 100 that indicates when baffle 201 deploys. FIGS. 7-8 illustrate an indicator mechanism 702 in an exemplary embodiment. Indicator mechanism 702 comprises any device that indicates when baffle 201 is deployed into the deployed position. In the embodiment shown in FIG. 7, indicator mechanism 702 may include a thermocouple wire 704 that is strung across the path of baffle 201 between the retracted position and the deployed position. Thermocouple wire 704 may be used to connect a temperature sensor 706 inside of autoclave 100 to instrumentation 708 outside of autoclave 100. Temperature sensor 706 is configured to read an air temperature within autoclave 100. Because thermocouple wire 704 is strung across the path of baffle 704, baffle 704 will break the connection made by thermocouple wire 704 between temperature sensor 706 and instrumentation 708 when it rotates from the retracted position to the deployed position (see FIG. 8). For instance, assume that temperature sensor 706 reads temperatures increasing from 70° F. to 180° F., which are displayed to an operator by instrumentation 708. When baffle 201 is released at the target temperature and pivots towards the deployed position, baffle 201 breaks the connection between temperature sensor 706 and instrumentation 708. Therefore, instrumentation 708 will show a rapid decrease in temperature because the connection with temperature sensor 706 is lost. This indicates to the operator that baffle 201 has been deployed.

The structure of indicator mechanism 702 as shown in FIGS. 7-8 is just an example, and may vary as desired. For example, a laser sensor may be installed in autoclave 100 to detect when baffle 201 deploys, a switch may be installed in autoclave 100 that is pressed or contacted by baffle 201 when deployed, etc.

Multiple baffle elements 150 as described above may be installed within autoclave 100. The number and locations of the baffle elements 150 may depend on the temperature distribution within autoclave 100, and the airflow changes desired during a run cycle. The size and shape of each baffle element 150 may differ depending on the airflow changes desired in autoclave 100. Also, different baffle elements 150 may be utilized that deploy at different temperatures. For example, an operator of autoclave 100 may want one baffle element 150 to deploy at target temperature t1, another baffle element 150 to deploy at target temperature t2, and another baffle element 150 to deploy at target temperature t3, which are different temperatures. To do so, the release mechanism 310 for each baffle element 150 is configured to deploy at the different target temperatures.

Figure 9:
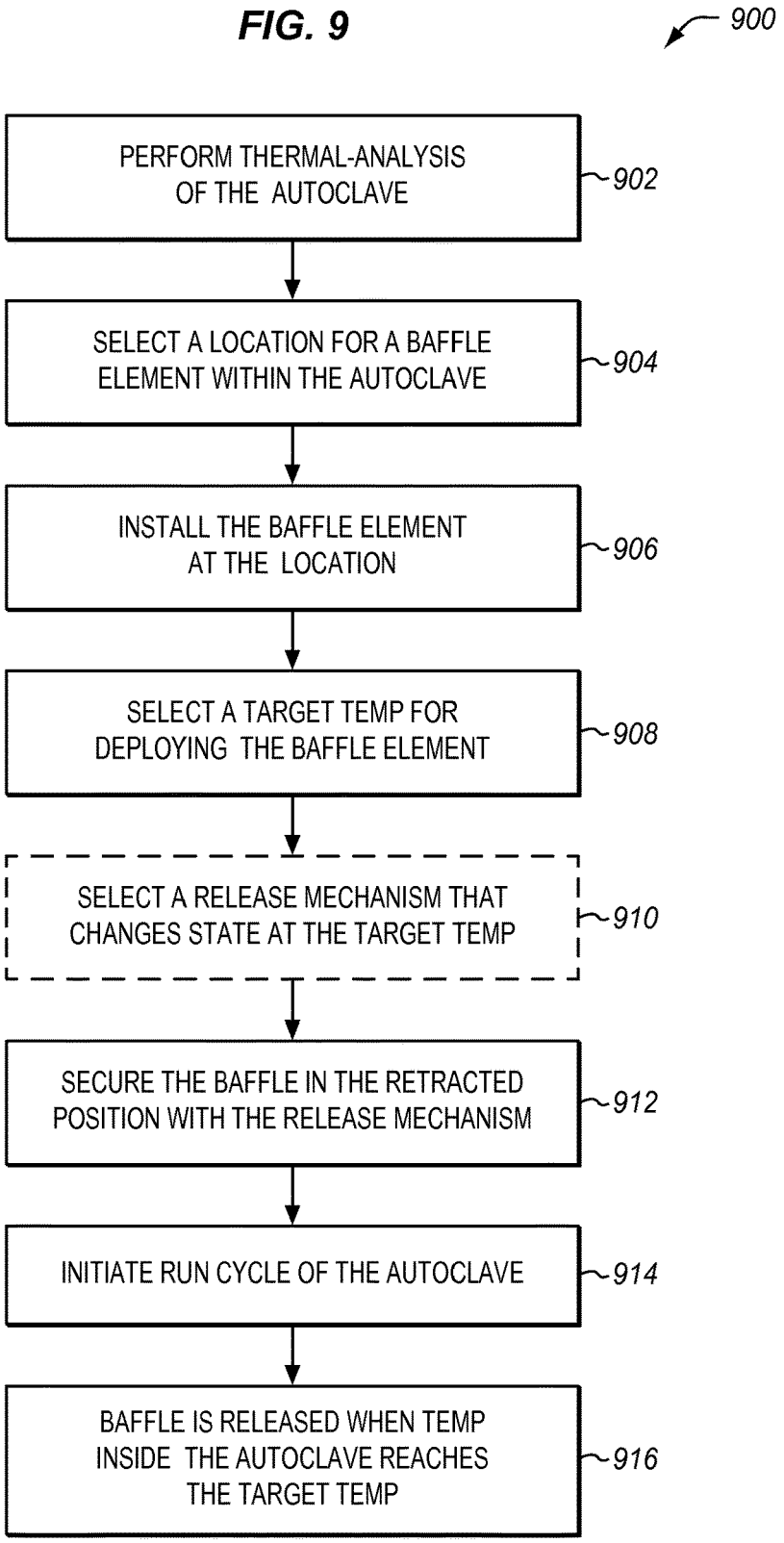
FIG. 9 is a flow chart illustrating a method of operating an autoclave in an exemplary embodiment.

An operator of autoclave 100 may use baffle element 150 in manufacturing processes, such as for curing composite materials. FIG. 9 is a flow chart illustrating a method 900 of operating autoclave 100 in an exemplary embodiment. The steps of the methods described herein are not all inclusive and may include other steps not shown. The steps for the flow charts shown herein may also be performed in an alternative order.

Method 900 includes performing a thermal-analysis of autoclave 100 (step 902), and more particularly, a thermal-analysis of interior 104 of autoclave 100. For instance, a modeling program may be used to model the volume of autoclave 100, airflow patterns within autoclave 100, temperature variations within autoclave 100, etc. The modeling program may also be used to model the airflow with one or more workpieces loaded within autoclave 100. Because more airflow across a workpiece improves heat transfer to the workpiece, and less airflow across the workpiece decreases heat transfer to the workpiece, heat transfer from the airflow to regions of the workpiece may be identified or modeled. Different heat transfer characteristics may be more evident on larger workpieces.

Method 900 may further include selecting a location for a baffle element 150 within autoclave 100 based on the thermal-analysis (step 904). The location for baffle element 150 may be selected for altering the airflow 330 during a run cycle of autoclave 100 to change the heat transfer on one or more regions of the workpiece. For example, if the thermal-analysis indicates a faster airflow along one region of the workpiece and a slower airflow along another region, the location of baffle element 150 may be selected to change the airflow pattern with autoclave 100 so that these different regions of the workpiece are heated to similar temperatures. Baffle element 150 may be situated to deflect air from a faster-airflow area within autoclave 100 to slower-airflow areas within autoclave 100. Baffle element 150 is then installed at the selected location (step 906). The modeling program may also be used to select the location for baffle element 150, and to determine how baffle element 150 affects the airflow pattern within autoclave 100.

Method 900 further includes selecting a target temperature for deploying the baffle element 150 during a run cycle of autoclave 100 (step 908). Method 900 may further include selecting a release mechanism 310 that changes state at the target temperature (step 910). Step 910 is an optional step depending on the type of release mechanism 310 that is used. For example, the operator may select a material for release mechanism 310 that melts at the target temperature, changes shape (e.g., SMA) at the target temperature, or otherwise changes state at the target temperature. Method 900 further includes securing the baffle 201 of the baffle unit 150 in the retracted position with the release mechanism (step 912).

Steps 904-912 may be performed multiple times for multiple baffle elements 150 as desired.

With the baffle element(s) 150 installed within autoclave 100 at the desired location(s) and set in the retracted position, a run cycle for autoclave 100 may be initiated (step 914). It is assumed that workpieces are also loaded into autoclave 100 for the run cycle. The run cycle includes pressurizing autoclave 100, and ramping up the temperature within autoclave 100 to a hold temperature. When the temperature of airflow 330 proximate to or surrounding the release mechanism 310 of baffle element 150 reaches the target temperature, the baffle 201 is released and pivots from the retracted position to the deployed position (step 916). The deployment of baffle 201 changes the airflow within autoclave 100. This changes the heat transfer coefficient at various locations around workpieces within autoclave 100. By being able to change the heat transfer coefficient during a run cycle of autoclave 100, all regions of a workpiece (especially a large workpiece) are subjected to similar temperatures during the run cycle. For example, if the workpieces are composites that are being cured, all regions of the composite will be cured according to the desired cure specifications.

Figure 10:
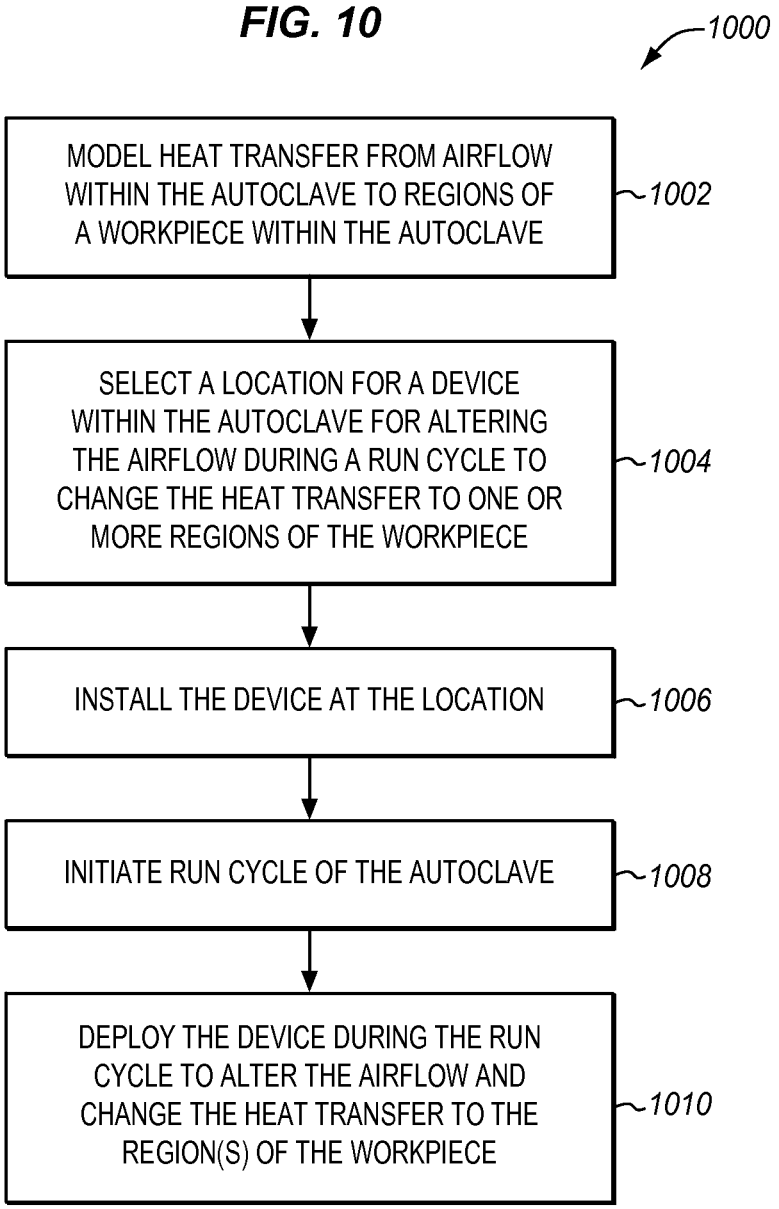
FIG. 10 is a flow chart illustrating a method of controlling heat in an autoclave in an exemplary embodiment.

Deployment of a baffle element 150 during a run cycle of autoclave 100 enables control over heat within autoclave 100 on different regions of a workpiece. FIG. 10 is a flow chart illustrating a method 1000 of controlling heat in autoclave 100 in an exemplary embodiment. For method 1000, heat transfer from airflow 330 to regions of a workpiece within autoclave 100 are modeled (step 1002). Heat transfer refers to the exchange of thermal energy between airflow 330 and the workpiece within autoclave 100. The heat transfer can be modeled based on the airflow patterns within autoclave 100. The modeling may indicate the regions on the workpiece with higher heat transfer, and indicate regions on the workpiece with lower heat transfer. Method 1000 may further include selecting a location for a device (e.g., baffle element 150) within autoclave 100 for altering the airflow 330 (step 1004). The location for the device may be selected for altering the airflow 330 during a run cycle of autoclave 100. The device may then be installed at the selected location (step 1006) within autoclave 100, such as on the ceiling, wall, or floor of autoclave 100, on a substructure within the autoclave 100, etc. Method 1000 further includes initiating a run cycle of autoclave 100 (step 1008). During the run cycle, the device (e.g., baffle element 150) is deployed within autoclave 100 to alter the airflow 330 within autoclave 100 and change the heat transfer to one or more of the regions of the workpiece (step 1010). As above, the device may be deployed when the temperature of airflow 330 reaches a target temperature.

Figure 11:
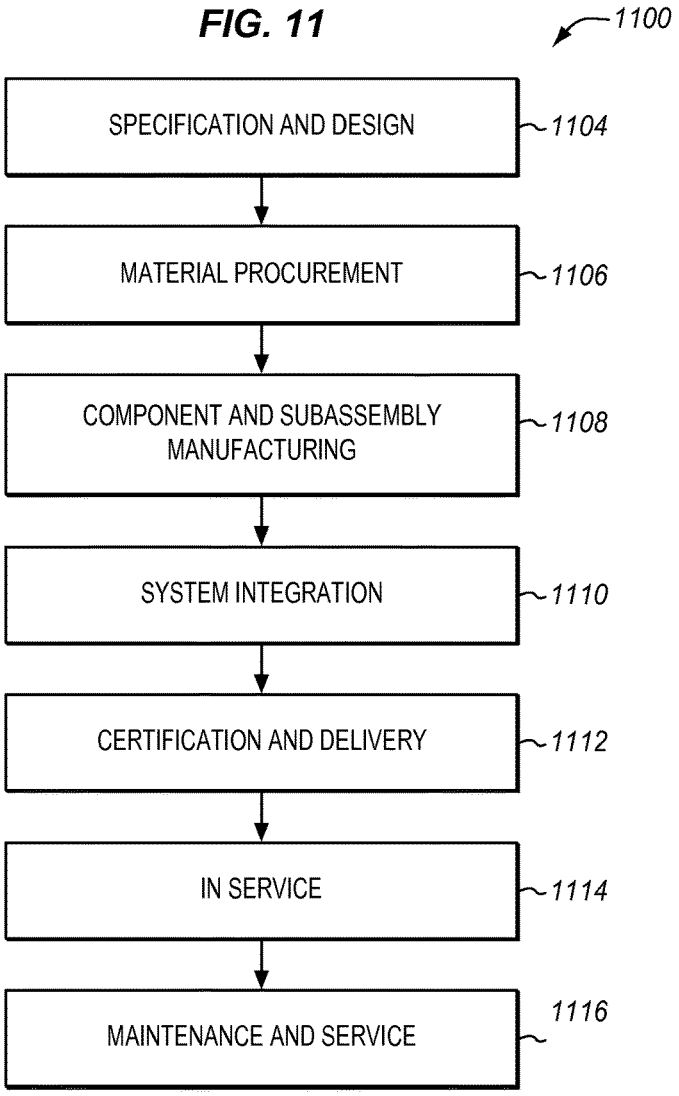
FIG. 11 is a flow chart illustrating an aircraft manufacturing and service method in an exemplary embodiment.
Figure 12:
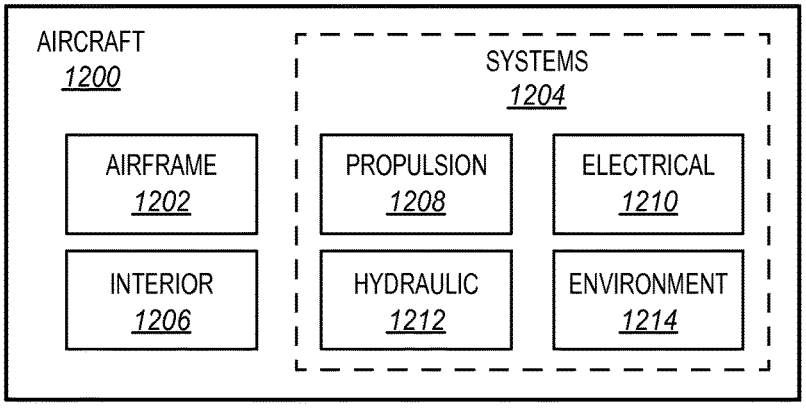
FIG. 12 is a schematic diagram of an aircraft in an exemplary embodiment.

The embodiments of the disclosure may be described in the context of an aircraft manufacturing and service method 1100 as shown in FIG. 11 and an aircraft 1100 as shown in FIG. 12. During pre-production, exemplary method 1100 may include specification and design 1104 of aircraft 1200, and material procurement 1106. During production, component and subassembly manufacturing 1108 and system integration 1110 of aircraft 1200 takes place. Thereafter, aircraft 1200 may go through certification and delivery 1112 in order to be placed in service 1114. While in service by a customer, aircraft 1200 is scheduled for routine maintenance and service 1116 (which may also include modification, reconfiguration, refurbishment, and so on).

Each of the processes of method 1100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 12, aircraft 1200 produced by exemplary method 1100 may include an airframe 1202 with a plurality of systems 1204 and an interior 1206. Examples of high-level systems 1204 include one or more of a propulsion system 1208, an electrical system 1210, a hydraulic system 1212, and an environmental system 1214. Any number of other systems may be included. Although an aerospace example is shown, the principles described in this specification may be applied to other industries, such as the automotive industry.

Apparatus and methods embodied herein may be employed during any one or more of the stages of the production and service method 1100. For example, components or subassemblies corresponding to production process 1108 may be fabricated or manufactured in a manner similar to components or subassemblies produced while aircraft 1200 is in service. Also, one or more apparatus embodiments, method embodiments, or a combination thereof may be utilized during the production stages 1108 and 1110, for example, by substantially expediting assembly of or reducing the cost of aircraft 1200. Similarly, one or more of apparatus embodiments, method embodiments, or a combination thereof may be utilized while aircraft 1200 is in service, for example and without limitation, to maintenance and service 1116.

Any of the various elements shown in the figures or described herein may be implemented as hardware, software, firmware, or some combination of these. For example, an element may be implemented as dedicated hardware. Dedicated hardware elements may be referred to as "processors", "controllers", or some similar terminology. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, a network processor, application specific integrated circuit (ASIC) or other circuitry, field programmable gate array (FPGA), read only memory (ROM) for storing software, random access memory (RAM), non-volatile storage, logic, or some other physical hardware component or module.

Also, an element may be implemented as instructions executable by a processor or a computer to perform the functions of the element. Some examples of instructions are software, program code, and firmware. The instructions are operational when executed by the processor to direct the processor to perform the functions of the element. The instructions may be stored on storage devices that are readable by the processor. Some examples of the storage devices are digital or solid-state memories, magnetic storage media such as a magnetic disks and magnetic tapes, hard drives, or optically readable digital data storage media.

Although specific embodiments were described herein, the scope is not limited to those specific embodiments. Rather, the scope is defined by the following claims and any equivalents thereof.

The invention claimed is:

1. An apparatus comprising:

a baffle located in an autoclave during a run cycle of the autoclave; and a latch that secures the baffle in a retracted position during the run cycle, and releases the baffle to a deployed position during the run cycle when a temperature inside of the autoclave reaches a target temperature to alter airflow within the autoclave.

2. The apparatus of claim 1 wherein:

the baffle attaches to a location within the autoclave with a hinge mechanism; and the baffle is configured to pivot via the hinge mechanism from the retracted position to the deployed position.

3. The apparatus of claim 1 wherein:

the latch includes a material that melts at the target temperature to release the baffle to the deployed position.

4. The apparatus of claim 1 wherein:

the latch includes a material that softens at the target temperature, and flexes to release the baffle to the deployed position.

5. The apparatus of claim 1 wherein:

the latch includes a Shape-Memory Alloy (SMA) material that has a first shape to secure the baffle in the retracted position, and transforms to a second shape at the target temperature to release the baffle to the deployed position.

6. The apparatus of claim 1 further comprising:

a spring mechanism that loads when the baffle is secured in the retracted position, and applies a return force to pivot the baffle to the deployed position when released.

7. The apparatus of claim 1 further comprising:

a stop that stops rotation of the baffle at the deployed position.

8. The apparatus of claim 1 further comprising:

an indicator that indicates when the baffle is released to the deployed position.

9. The apparatus of claim 8 wherein:

the indicator includes a thermocouple wire installed in a path between the retracted position and the deployed position of the baffle; and the baffle breaks a connection of the thermocouple wire when pivoting from the retracted position to the deployed position.

10. An apparatus comprising:

an autoclave; and at least one baffle element installed within the autoclave; wherein the at least one baffle element includes:

a baffle;

a hinge mechanism that attaches the baffle to a surface inside of the autoclave, wherein the baffle is configured to pivot via the hinge mechanism from a retracted position to a deployed position to alter airflow within the autoclave; and a latch that secures the baffle in the retracted position during a run cycle of the autoclave, and automatically releases the baffle to the deployed position during the run cycle when a temperature inside of the autoclave reaches a target temperature.

11. The apparatus of claim 10 wherein the at least one baffle element comprises:

a first baffle element installed inside of the autoclave at a first location; and a second baffle element installed inside of the autoclave at a second location;

wherein the first baffle element and the second baffle element are configured to deploy at different target temperatures during the run cycle.

12. The apparatus of claim 10 wherein:

the at least one baffle element is installed on a ceiling of the autoclave.

13. The apparatus of claim 10 wherein:

the latch attaches to the surface inside of the autoclave, and contacts the baffle to secure the baffle in the retracted position; and the latch includes a material that melts at the target temperature to release the baffle to the deployed position.

14. The apparatus of claim 10 wherein:

the latch attaches to the surface inside of the autoclave, and contacts the baffle to secure the baffle in the retracted position; and the latch includes a material that softens at the target temperature, and flexes to release the baffle to the deployed position.

15. The apparatus of claim 10 wherein:

the latch attaches to the surface inside of the autoclave, and contacts the baffle to secure the baffle in the retracted position; and the latch includes a Shape-Memory Alloy (SMA) material that has a first shape to secure the baffle in the retracted position, and transforms to a second shape at the target temperature to release the baffle to the deployed position.

16. The apparatus of claim 10 wherein:

the at least one baffle element includes:

a spring mechanism that loads when the baffle is secured in the retracted position, and applies a return force to pivot the baffle to the deployed position when released.

17. The apparatus of claim 10 wherein:

the at least one baffle element includes:

a stop that stops rotation of the baffle at the deployed position.

18. The apparatus of claim 10 further comprising:

an indicator that indicates when the baffle is released to the deployed position.

19. The apparatus of claim 18 wherein:

the indicator includes a thermocouple wire installed in a path between the retracted position and the deployed position of the baffle; and the baffle breaks a connection of the thermocouple wire when pivoting from the retracted position to the deployed position.

20. A method of operating an autoclave, the method comprising:

performing a thermal-analysis of the autoclave;

selecting a location for a baffle element within the autoclave based on the thermal-analysis;

installing the baffle element at the location, wherein the baffle element includes a baffle that attaches to a location inside of the autoclave via a hinge mechanism, and that pivots between a retracted position and a deployed position via the hinge mechanism;

selecting a target temperature for deploying the baffle during a run cycle of the autoclave;

securing the baffle in the retracted position with a latch;

initiating the run cycle; and releasing the baffle to the deployed position with the latch during the run cycle when a temperature inside the autoclave reaches the target temperature.

21. The method of claim 20 further comprising:

selecting the latch so that the latch changes state at the target temperature.

22. The method of claim 21 wherein selecting the latch that changes state at the target temperature comprises:

selecting a material for the latch that melts at the target temperature to release the baffle to the deployed position.

23. The method of claim 21 wherein selecting the latch that changes state at the target temperature comprises:

selecting a material for the latch that softens at the target temperature, and flexes to release the baffle to the deployed position.

24. The method of claim 21 wherein selecting the latch that changes state at the target temperature comprises:

selecting a Shape-Memory Alloy (SMA) material for the latch that transforms shapes at the target temperature to release the baffle to the deployed position.

25. The method of claim 20 further comprising:

installing an indicator that indicates when the baffle is released to the deployed position.

26. The method of claim 25 wherein installing the indicator comprises:

installing a thermocouple wire in a path between the retracted position and the deployed position of the baffle;

wherein the baffle breaks a connection of the thermocouple wire when pivoting from the retracted position to the deployed position.

27. A method of controlling heat within an autoclave, the method comprising:

initiating a run cycle of the autoclave; and deploying a baffle within the autoclave during the run cycle from a retracted position to a deployed position to alter airflow within the autoclave and change heat transfer from the airflow to at least one region of a workpiece.

28. The method of claim 27 wherein deploying the baffle comprises:

automatically deploying the baffle during the run cycle when a temperature inside the autoclave reaches a target temperature.

29. The method of claim 28 further comprising:

selecting the target temperature for deploying the baffle based on a modeling of the heat transfer.

30. The method of claim 27 further comprising:

modeling the heat transfer from the airflow within the autoclave to regions of the workpiece within the autoclave.

31. The method of claim 27 further comprising:

selecting a location for the baffle within the autoclave based on a modeling of the heat transfer; and installing the baffle at the location, wherein the baffle attaches to a surface inside of the autoclave via a hinge mechanism, and pivots between the retracted position and the deployed position via the hinge mechanism.

* * * * *